US006223926B1

(12) United States Patent
Craven et al.

(10) Patent No.: US 6,223,926 B1
(45) Date of Patent: May 1, 2001

(54) UNDERGROUND RAKE STORAGE DEVICE

(76) Inventors: Carl Craven; Judy A. Craven, both of 7126 N. Via Nueva, Scottsdale, AZ (US) 85258

( * ) Notice: Subject to any disclaimer, the term of this patent is extended or adjusted under 35 U.S.C. 154(b) by 0 days.

(21) Appl. No.: 09/390,611

(22) Filed: Sep. 3, 1999

(51) Int. Cl.[7] ..... B65D 25/00
(52) U.S. Cl. ..... 220/484; 220/501
(58) Field of Search ..... 220/484, 501, 220/DIG. 13

(56) References Cited

U.S. PATENT DOCUMENTS

| | | | | |
|---|---|---|---|---|
| 60,078 | | 11/1866 | Speirs . | |
| 419,905 | * | 1/1890 | Zapp | 220/484 |
| 2,757,045 | | 7/1956 | Nullet . | |
| 2,791,347 | | 5/1957 | Boehm . | |
| 3,515,263 | | 6/1970 | Carlson . | |
| 3,800,973 | * | 4/1974 | Weaver | 220/484 |
| 4,162,740 | * | 7/1979 | Jones | 220/484 X |
| 4,838,416 | | 6/1989 | Carman . | |
| 4,934,550 | | 6/1990 | Cash . | |

* cited by examiner

*Primary Examiner*—Steven Pollard
(74) *Attorney, Agent, or Firm*—Schmeiser, Olsen & Watts

(57) ABSTRACT

A storage device (10) includes an underground chamber (12) and a lid (31) hinged to the chamber (12). The lid (31) has a tab (36) and can be easily opened by a user. Flanges (23, 25, 27, 29) near the top of the chamber (12) prevent the storage device (10) from setting too deep in the ground (60) and prevent water from flowing into the chamber (12). A pipe (14) attached to the base (15) of the chamber (12) surrounding an opening (16) therein receives the handle (54) of an implement (50) when the head (52) of the implement (50) is stored in the chamber (12) and provides drainage to the chamber (12). A block (18) on the base (15) of the chamber (12) lifts the head (52) of the implement (50) off the base (15), thereby protecting the implement (50) from possible water and litter in the chamber (12).

15 Claims, 3 Drawing Sheets

UNDERGROUND RAKE STORAGE DEVICE

FILED OF THE INVENTION

The present invention relates, in general, to storage devices and, more particularly, to specifically configured underground stored devices.

BACKGROUND OF THE INVENTION

Underground storage devices are known.

U.S. Pat. No. 4,934,550 issued to Cash discloses a storage device for a rake that includes a chamber buried under it the ground with an upwardly opening exposed. The chamber with an opening upwardly exposes the rake stored therein to rainwater and debris, which may defile the rake and make the rake unpleasant to use. The debris may also clog the lower part of the chamber and prevent the rake handle to be inserted therein.

U.S. Pat. No. 3,584,739 issued to Erichson et al. discloses a rake for use in a golf course sand trap. The rake has a head portion on the same plane as the handle which extends at an angle therefrom. When not in use, the rake is horizontally stored in a container buried in the ground adjacent a sand trap. The container is provided with a hinged cover having an artificial turf surface flush with the ground. Downward pressure on the cover unlatches the cover and an internal spring opens the cover and raises the rake handle from the container. A container that stores a rake horizontally occupies a large ground area. The latch and internal spring design is complicated and cost inefficient. Further the internal spring is subject to rust and failure, thereby adversely affecting the durability of the container.

Accordingly it would be advantageous to have a simple and inexpensive underground storage device for storing an implement such as a rake used on a golf course sand trap. It is desirable for the storage device to be reliable, durable, and user friendly. It is also desirable for the storage device to effectively protect the implement from the environment. It would be of further advantage for the storage device to be space efficient, e.g., occupying a small ground area.

SUMMARY OF THE INVENTION

A general object of the present invention is to provide a simple and cost efficient storage device for storing an implement. A particular object of the present invention is to provide an underground rake storage device in a golf course. Another object of the present invention is to effectively protect the implement stored in the storage device from the environment. An additional object of the present invention is to provide a storage device that is user friendly. A further object of the present invention is to provide the storage device that occupies a relatively small surface area on the ground.

These and other objects of the present invention are achieved through a storage device that includes a chamber for storing the head of the implement and a lid covering the chamber and protecting the implement from the environment. An opening is formed in the base of the chamber for receiving the handle of the implement when the head of the implement is stored in the chamber. The lid is pivotally mounted on the chamber and can be easily opened by a user. The chamber can be buried in the ground with the lid exposed and substantially flush with the ground. In a preferred embodiment, flanges are formed near the top of the chamber. The flanges serve to the chamber from setting too deep in the ground. The flanges can also be configured to prevent water on the ground from flowing into the chamber, thereby providing additional protection to the implement stored in the chamber. In another preferred embodiment, the base of the chamber is slanted to drain any water that might be in the chamber through the opening in the base. A second chamber can be attached to the base of the chamber surrounding the opening. Preferably, the second chamber is made of a bottomless tube. The tube receives the handle of the implement when the head of the implement is stored in the chamber and provides drainage to the chamber. Furthermore, a block can be formed on the base of the chamber. The block serves to lift the head of the implement off the base of the chamber, further protecting the implement from possible water and litter in the chamber. The implement stored in the storage device is kept dry and clean and, therefore, is pleasant to use.

Figure 1:
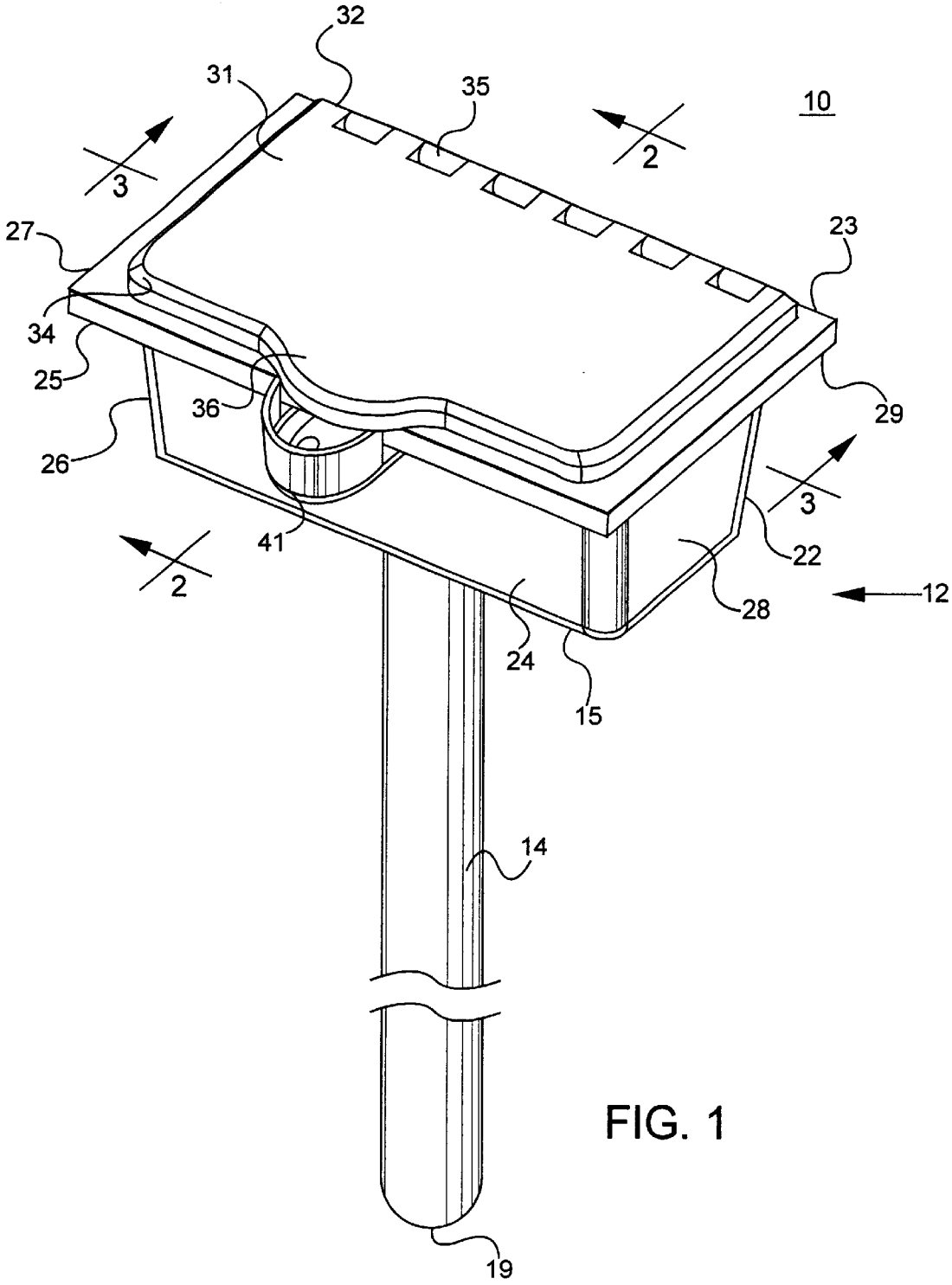
FIG. 1 is an isometric view of a storage device in accordance with the present invention.

It should be noted that the figures are merely schematic representations, which are not intended to portray specific parameters of the present invention. The figures should not be considered as limiting the scope of the present invention. In addition, the figures are not drawn to scale. Elements having similar functions are labeled using the same reference numerals in the figures.

DESCRIPTION OF THE PREFERRED EMBODIMENTS

Figure 2:
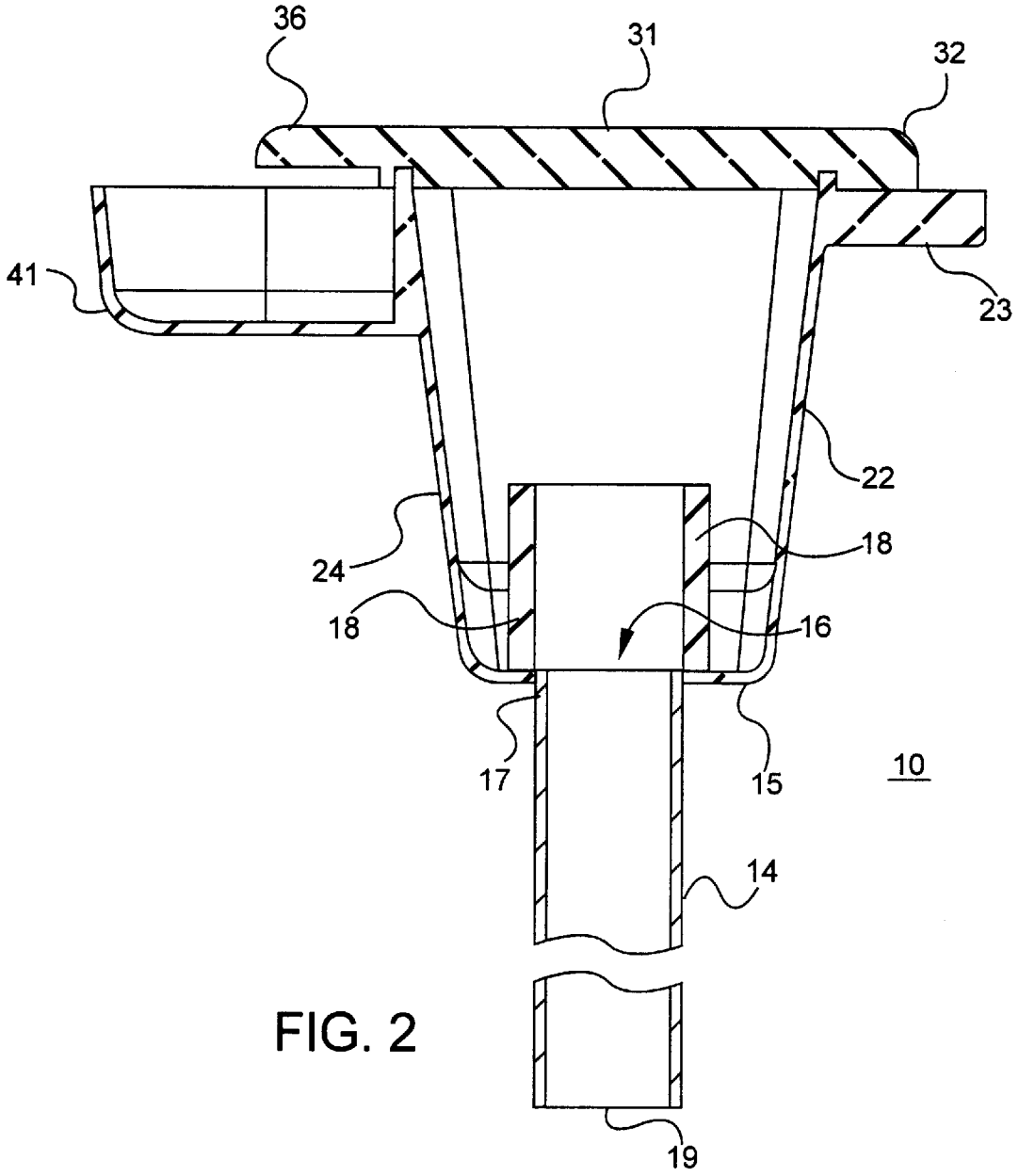
FIG. 2 is a cross sectional view of the storage device shown in FIG. 1 along a cross section 2—2.

Preferred embodiments of the present invention are described herein below with reference to the drawings. FIG. 1 is an isometric view of a storage device 10 in accordance with the present invention; FIG. 2 is a cross sectional view of storage device 10 along a cross section 2—2 shown in FIG. 1; and FIG. 3 is a cross sectional view of storage device 10 along a cross section 3—3 shown in FIG. 1 as storage device 10 is installed in ground.

The present invention provides storage device 10 for storing an implement. By way of example, the implement is a rake 50 (shown in FIG. 3) used in a golf course, and storage device 10 is buried under ground 60 (shown in FIG. 3) near a sand trap in the golf course. Therefore, storage device 10 is also referred to as an underground rake storage. Storage device 10 includes chambers 12 and 14 attached to each other. Chambers 12 and 14 are adapted for receiving a head 52 and a handle 54, respectively, rake 50 (shown in FIG. 3) and are also referred to as a head chamber and a handle chamber, respectively.

Head chamber 12 is comprised of a base 15 and a plurality of side walls coupled to base 15. More particularly, head chamber 12 has a back side wall 22 and a front side wall 24 opposite to each other, and a left side wall 26 and a right side wall 28 opposite to each other and coupled between front side wall 22 and front side wall 24. When storage device 10 is buried under ground 60, the tops of side walls 22, 24, 26, and 28 are substantially flush with ground 60. Base 15 is coupled to the bottoms of side walls 22, 24, 26, and 28. Base 15 has an opening 16 (shown in FIGS. 2 and 3) therein adapted for receiving handle 54 of rake 50. Head chamber 12 can be made of any kind of solid materials such as, for example, plastic, metal, wood, etc. Molded plastic is usually preferred because of its low cost and resistance to under various weather and ground conditions that may be present in a golf course.

Figure 3:
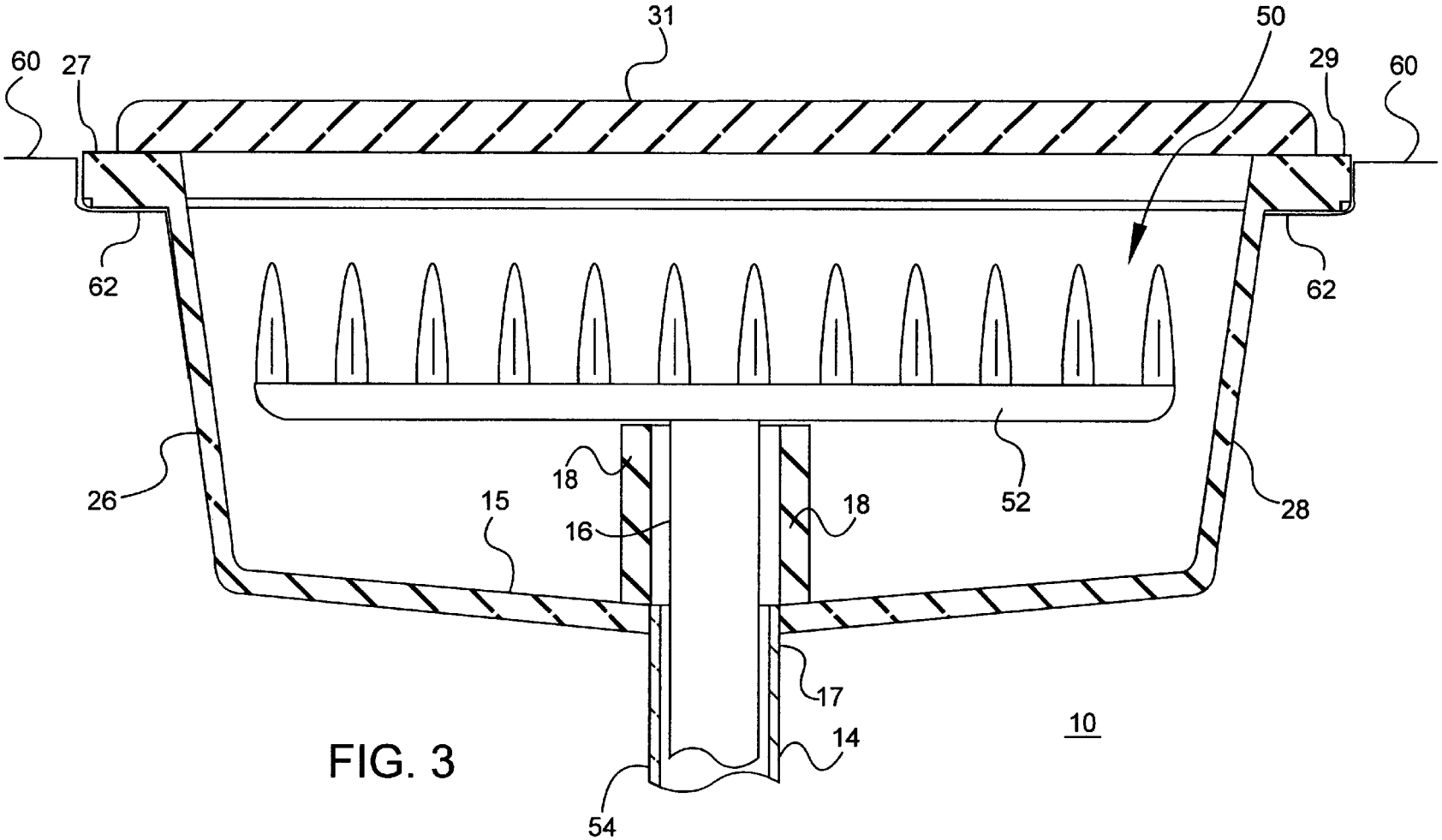
FIG. 3 is a cross sectional view of the storage device shown in FIG. 1 along a cross section 3—3 as the storage device is installed in the ground.

Base 15 of head chamber 12 is optionally slanted as shown in FIG. 3 so that the a depth of head chamber 12 adjacent opening 16 in base 15 is greater than a depth head chamber 12 adjacent side walls 22, 24, 26, and 28. Slanted base 15 facilitates the drainage of head chamber 12 and helps to keep rake 50 dry and clean. Additional preferred but optional features that benefit the upkeep of rake 50 stored in storage device 10 include a block 18 (shown in FIGS. 2 and 3) on base 15 and flanges 23, 25, 27, and 29 extending from side walls 22, 24, 26, and 28, respectively. Block 18 preferably surrounds opening 16 in base 15. However, this is not a limitation of the present invention. Further, head chamber 12 may include more than one block on base 15. When block 18 surrounds opening 16, it is also referred to as a collar surrounding opening 16. Block 18 lifts head 52 of rake 50 off base 15 and helps to keep rake 50 dry and clean. Flanges 23, 25, 27, and 29 extend from side walls 22, 24, 26, and 28, respectively, near their tops. They prevent further deepening of storage device 10 in ground 60 (shown in FIG. 3). In one preferred embodiment, ground 60 has a recess 62 (shown in FIG. 3) for receiving flanges 23, 25, 27, and 29 so that the tops of flanges 23, 25, 27, and 29 are substantially flush with ground 60. In another preferred embodiment (not shown), the bottoms of flanges 23, 25, 27, and 29 sit on ground 60. In addition, flanges 23, 25, 27, and 29 can be tapered off toward the edges. Furthermore, the tops of side walls 22, 24, 26, and 28 can protrude above flanges 23, 25, 27, and 29, respectively. These optional features facilitate to prevent ground water from leaking into head chamber 12. It should be noted that head chamber 12 is not limited to having four flanges 23, 25, 27, and 29 extending from side walls 22, 24, 26, and 28, respectively. In alternative embodiments, head chamber 12 can include no flange at all or include one, two, three flanges extending from selected side walls of head chamber 12. Flanges 23, 25, 27, and 29 can also be molded as a single flange extending from the tops of side walls 22, 24, 26, and 28 of head chamber 12. Block 18 and flanges 23, 25, 27, and 29 can be either formed integral with base 15 and side walls 22, 24, 26, and 28 of head chamber 12 or formed as separate parts and subsequently attached to head chamber 12. In a preferred embodiment, head chamber 12 is made of molded plastic and includes all desired features such as, for example, block 18 and flanges 23, 25, 27, and 29.

A cover or lid 31 is removably and pivotally coupled to the top of back side wall 22 of head chamber 12. In a preferred embodiment, a hinge 35 is used to couple a side 32 of lid 31 to the top of back side wall 22 of head chamber 12. In order to achieve a lower cost and better reliability, head chamber 12 and lid 31 are preferably made of the same plastic material and the molding processes of forming head chamber 12 and lid 31 also form hinge 35. Alternatively, hinge 35 can be attached to the top of back side wall 22 and side 32 of lid 31 using glues, bolts, or other fastening mechanisms. Depending on how storage device 10 is buried, lid 31 can be either substantially flush with or slightly above ground 60. Further, lid 31 can be covered with an artificial turf (not shown) for desired visual appearance.

For easy opening, lid 31 preferably includes a tab 36 on a side 34 (shown in FIGS. 1 and 2) opposite to hinge 35 at side 32. A user can open lid 31 by putting his/her finger under tab 36 and lifting it. Tab 36 is also referred to as a lift tab. Further, storage device 10 preferably includes a compartment 41 (shown in FIGS. 1 and 2) at the top of front side wall 24 under tab 36 when lid 31 is closed on head chamber 12. Compartment 41 has an opening into which the user can insert his/her finger under tab 36 to open lid 31. Compartment 41 also helps to keep tab 36 clean of dirt and other undesirable debris that may be present near storage device 10. Preferably, tab 36 is an integral part of lid 31. Likewise, compartment 41 is preferably integral with front side wall 24 and formed in the same molding or casting process that forms head chamber 12. Compared with prior art spring loaded mechanism, lift tab 36 and compartment 41 of the present invention are simpler, more cost efficiency, and more durable. It should be noted that, although preferred, both lift tab 36 and compartment 41 are optional features in storage device 10. Further, compartment 41 is not limited to having a semicircular cross section as shown in FIG. 1. Compartment 41 can have a cross section of any shape, e.g., rectangular, triangular, trapezoidal, etc.

Handle chamber 14 is an elongated tube or pipe for receiving handle 54 of rake 50. An upper end 17 (shown in FIGS. 2 and 3) of handle chamber 14 is coupled to base 15 of head chamber 12. Upper end 17 surrounds opening 16 in base 15 so that handle chamber 14 communicates with head chamber 12 through opening 16. A lower end 19 (Shown in FIGS. 1 and 2) of handle chamber 14 is preferably an open end, thereby providing drainage for storage device 10. Possible methods of coupling handle chamber 14 to head chamber 12 include molding, gluing, pipefitting, welding, etc. Further, storage device 10 can include a rubber seal (not shown) over opening 16. The optional seal has a slit through which handle 54 of rake 50 is inserted into handle chamber 14. The seal helps to prevent debris falling into handle chamber 14 and clogging handle chamber 14.

By now it should be appreciated that a simple and inexpensive storage device for storing an implement such as a rake used in a golf course has been provided. The storage device of the present invention is simple, easy to make, cost efficient, and durable. Compared with prior art storage devices, the storage device of the present invention provides better protection to the implement stored therein from the environment and is more user friendly. Further, the storage of the present invention is space efficient, i.e., it occupies a small ground area.

While specific embodiments of the present invention have been shown and described, further modifications and improvements will occur to those skilled in the art. Specifically, the storage device of the present invention is not limited to storing a rake in a golf course. Storage devices in accordance with the present invention can be used in storing other implements such as, for example, sledge hammers, axes, picks, hoes, etc.

What is claimed is:

1. A storage device for storing an implement having a head and a handle, the storage device comprising:

a first chamber having a plurality of side walls and a base coupled to said plurality of side walls, said base having an opening adapted for receiving the handle of the implement when the head of the implement is stored in said first chamber between said plurality of side walls, wherein said plurality of side walls of said first chamber includes:

a first side wall and a second side wall opposite to each other; and a third side wall and a fourth side wall opposite to each other and coupled between said first side wall and said second side wall;

a lid removably coupled to said first chamber wherein said lid is pivotally coupled to said first side wall and has a lift tab adjacent to said second side wall when said lid is closed on said first chamber; and a compartment coupled to said second side wall of said first chamber, said compartment having an opening adjacent to said lift tab on said lid when said lid is closed on said first chamber.

2. The storage device of claim 1, wherein said first chamber is buried under ground with said lid exposed.

3. The storage device of claim 1, wherein said lid is pivotally coupled to a side wall of said plurality of side walls of said first chamber via a hinge.

4. The storage device of claim 1, further comprising at least one flange extending from at least one side wall of said plurality of side walls of said first chamber.

5. The storage device of claim 1, wherein said first chamber has a first depth adjacent a side wall of said plurality of side walls and a second depth adjacent the opening in said base, the second depth being greater than the first depth.

6. The storage device of claim 1, further comprising a block on said base of said first chamber and adapted for lifting the head of the implement off said base of said first chamber.

7. The storage device of claim 1, further comprising a second chamber attached to said base of said first chamber and communicating with said first chamber through the opening in said base, said second chamber being adapted for receiving the handle of the implement when the head of the implement is stored in said first chamber.

8. A storage device, comprising:

a first chamber comprised of:

a first side wall having a top and a bottom;

a second side wall having a top and a bottom and opposite to said first side wall;

a third side wall having a top and a bottom and coupled between said first side wall and said second side wall;

a fourth side wall having a top and a bottom, opposite to said third side wall, and coupled between said first side wall and said second side wall; and a base couple to the bottoms of said first, second, third, and fourth side walls and having an opening adapted for receiving a handle of an implement when a head of the implement is in said first chamber;

a lid having a first side pivotally coupled to the top of said first side wall of said first chamber and a second side opposite to the first side adjacent the top of said second side wall of said first chamber when said lid is closed on said first chamber;

a compartment attached to the top of said second side wall of said first chamber, said compartment having an opening; and a tab on the second side of said lid adjacent to the opening of said compartment when said lid is closed on said first chamber.

9. The storage device of claim 8, further comprising a plurality of flanges extending from the tops of said first, second, third, and fourth side walls of said first chamber.

10. The storage device of claim 8, further comprising a block surrounding the opening in said base of said first chamber, said block being adapted for lifting the head of the implement off said base of said first chamber.

11. The storage device of claim 8, further comprising a second chamber attached to said base of said first chamber and communicating with said first chamber through the opening in said base, said second chamber being elongated and adapted for receiving the handle of the implement when the head of the implement is stored in said first chamber.

12. An underground rake storage, comprising:

a head chamber adapted for receiving a head of a rake and comprised of a plurality of side walls and a base coupled to said plurality of side walls, said base having a opening therein;

an handle chamber coupled to said base of said head chamber, communicating with said head chamber through the opening in said base of said head chamber, and adapted for receiving a handle of the rake;

a lid having a first side pivotally coupled to a first side wall of said plurality of side walls of said head chamber and a second side opposite to the first side and adjacent to a second side wall of said plurality of side walls of said head chamber when said lid is closed on said head chamber;

wherein said head chamber and said handle chamber are buried under ground with said lid exposed;

a lift tab on the second side of said lid, and a compartment on said second side wall of said plurality of side walls of said head chamber, said compartment having an opening adjacent said lift tab when said lid is closed on said head chamber.

13. The underground rake storage of claim 12, further comprising a plurality of flanges extending from said plurality of side walls and substantially flush with the ground.

14. The underground rake storage of claim 12, further comprising a collar surrounding the opening in said base of said head chamber and adapted for lifting the head of the rake off said base of said head chamber.

15. The underground rake storage of claim 12, wherein said handle chamber includes a tube attached to said base of said head chamber surrounding the opening in said base of said head chamber.

* * * * *